US008044749B1

(12) United States Patent
Witas et al.

(10) Patent No.: US 8,044,749 B1
(45) Date of Patent: Oct. 25, 2011

(54) COUPLER DEVICE

(75) Inventors: Tomasz M. Witas, Fayetteville, NY (US); Michael J. Lugert, Manlius, NY (US); Niels H. Kirkeby, Jamesville, NY (US)

(73) Assignee: Anaren, Inc., East Syracuse, NY (US)

( * ) Notice: Subject to any disclaimer, the term of this patent is extended or adjusted under 35 U.S.C. 154(b) by 114 days.

(21) Appl. No.: 12/392,649

(22) Filed: Feb. 25, 2009

Related U.S. Application Data

(60) Provisional application No. 61/031,511, filed on Feb. 26, 2008.

(51) Int. Cl.
*H01P 5/18* (2006.01)
*H01P 3/08* (2006.01)

(52) U.S. Cl. ..... 333/116; 333/112

(58) Field of Classification Search ..... 333/109, 333/110, 111, 112, 115, 116, 25, 26
See application file for complete search history.

(56) References Cited

U.S. PATENT DOCUMENTS 3,999,150 A 12/1976 Caragliano et al.
4,999,593 A 3/1991 Anderson
5,065,122 A 11/1991 Juskey et al.
5,369,379 A 11/1994 Fujiki
5,451,914 A * 9/1995 Stengel ..... 333/25
5,689,217 A 11/1997 Gu et al.
5,841,328 A 11/1998 Hayashi
6,099,677 A 8/2000 Logothetis et al.
6,686,812 B2 * 2/2004 Gilbert et al. ..... 333/112
6,765,455 B1 7/2004 DeLillo et al.

* cited by examiner

*Primary Examiner* — Dean Takaoka
(74) *Attorney, Agent, or Firm* — Daniel P. Malley; Bond Schoeneck & King

(57) ABSTRACT

The present invention is directed to a coupler that includes a coupler structure including at least one first transmission line disposed on a first major surface of a coupler dielectric substrate and at least one second transmission line disposed on a second major surface of the coupler dielectric substrate. The coupler structure includes four symmetric ports such that each port of the four symmetric ports is characterized by substantially identical impedance characteristics. A first ground plane structure is coupled to the coupler structure and including a first outer dielectric material and a first conductive exterior layer disposed substantially parallel to the first major surface. A second ground plane structure is coupled to the coupler structure and including a second outer dielectric material and a second conductive exterior layer disposed substantially parallel to the second major surface. A thermal path is disposed between the coupler structure and at least one of the first conductive exterior layer or second conductive exterior layer. The thermal path is characterized by a thermal resistance substantially within a range between 15 W/mK and 50 W/mK, such that the coupler has a power handling capability of more than 800 W per square inch of heat sink interface.

35 Claims, 6 Drawing Sheets

COUPLER DEVICE

CROSS-REFERENCE TO RELATED APPLICATIONS

This application claims priority to U.S. Provisional Patent Application Ser. No. 61/031,511, filed on Feb. 26, 2008, the content of which is relied upon and incorporated herein by reference in its entirety, and the benefit of priority under 35 U.S.C. §119(e) is hereby claimed.

BACKGROUND OF THE INVENTION

1. Field of the Invention

The present invention relates generally to radio-frequency (RF) and/or microwave components, and particularly to RF and/or microwave coupled transmission line components.

2. Technical Background

A coupler is a four-port passive device that is used to combine, split and/or direct an RF signal within an RF circuit in a predictable manner. A coupler may be implemented by disposing two transmission lines in relatively close proximity to each other. The main transmission line includes a first (input) port and a second (output) port. The secondary transmission line includes a third (output) port and a fourth (isolation) port. Couplers are designed to sample an RF signal, and output a coupled signal having predetermined signal characteristics (e.g., amplitude, frequency, phase, insertion loss, etc.).

Directional couplers operate in accordance with the principles of superposition and constructive/destructive interference of RF waves. When coupling occurs, the RF signal directed into the input port of coupler is split into two RF signals. A first portion of the RF signal is available at the second port and a second portion of the RF signal is available at the third port. The amount of RF signal power in the first and second output signals should equal the RF signal power of the input signal. However, the coupler usually has an "insertion loss" which accounts for the differences between the input signal and the output signals. The coupled output signal and the direct output signal are out of phase with respect to each other. At the isolation port, there is destructive interference of RF waves and the RF signals cancel such that there is no appreciable signal available at the fourth port. In practice, the cancellation is not perfect and a residual signal may be detected. The residual signal at the isolation port is another measure of the performance of the device. Hybrid couplers are commonly used in many wireless technologies to divide a power signal into two signals. In many instances the size of the coupler is critical for both application requirements and material cost benefits.

More formally, coupler structures can typically be described as two transmission lines of length/with an even and odd mode impedance, $Z_{0E}$ and $Z_{0O}$. The length of the coupler may be put in terms of the dielectric constant ($\in_R$) of the material used to implement the transmission line in accordance with the following formula:

$$l = \frac{c}{4f_0\sqrt{\varepsilon_r}}$$

Where c is the speed of light and $f_0$ is the desired center frequency.

The even mode impedance is the line impedance when the two coupled lines are at the same electric potential. The odd mode impedance is the line impedance when the lines have opposite electric potential. The overall system impedance of the coupled line pair is given by:

$$Z_0=\sqrt{Z_{0E}Z_{0O}}$$

The coupling factor, k, is given from the even and odd mode impedance parameters:

$$k = \frac{Z_{0e} - Z_{0o}}{Z_{0e} + Z_{0o}}$$

To achieve a tight coupling factor the even mode impedance must be relatively high and the odd mode impedance should be relatively low, while maintaining the proper system impedance. A 3 dB coupler in a 50 ohm system has an even mode impedance of approximately 120.7 ohms and an odd mode impedance of approximately 20.7 ohms. The length of the coupled lines is chosen to be a quarter wavelength (90°) long at the coupler's operating frequency ($f_0$) (i.e., the frequency of the RF signal being divided or combined).

There are various methods commonly used to implement a coupler structure. For example, broad side coupled lines and edge-side coupled lines are simple structures used to create couplers. The basic edge-side or broadside coupler may be modified to vary coupling value using various methods including re-entrant structures, spirals, meandered lines and lumped elements among others.

The broadside coupled line pair is a simple distributed coupling structure which can easily achieve tight coupling. This design is simply two stripline layers arranged together on top of one another, without a ground plane layer between the coupled line pair. Meandered broadside coupled lines are similar to the broadside coupled lines, but differ in that the broadside coupled line pair is disposed in a meandered pattern in an effort to achieve a more compact hybrid coupler. A design somewhat similar to the meandered pattern is the simple spiral design. If the spiral turns are arranged closely together then tight coupling is particularly easily achieved due to the minimized even mode fringing fields of each individual turn, resulting in a relative higher even mode impedance.

Each of the broadside coupled lines pairs described above have their advantages as well as disadvantages. From an impedance standpoint, the straight broadside coupled line pair and the meandered coupled line pairs both have symmetrical ports. Edge-side and/or broadside coupler topologies have drawbacks in that they are relatively large in the x-y direction because of the line length required. These types of designs are also characterized by a relatively large dimension along the z-axis to achieve to correct even mode impedance. Meandered broadside coupled lines also have size and density limitations. When meandered lines are disposed side-by-side, the RF currents flowing in adjacent lines tend to oppose each other. Accordingly, adjacent lines cannot be arranged in a tight configuration. This reality, of course, limits the spatial density of meandered line configurations. What is needed is a coupler line configuration that provides an increased line density suitable for implementing miniaturized coupler devices.

A simple spiral configuration is a method that may be employed to achieve tight coupling in a small area. However, since there is no symmetry along the z-axis there is a varying impedance value for the inside and outside ports. This affects the coupler's ability to divide and combine RF signals, particularly in high efficiency amplifiers, where the amplifier impedance changes with the amplitude of the signal. A simple spiraled coupled line pair achieves tight coupling values and may be implemented in a miniaturized form factor. The spiral structure allows for tighter coupling and smaller lines and spaces, which allows the coupler to shrink in the x, y and z directions.

As alluded to above, the so-called spiral coupler structure has a serious drawback, however, since port locations are disposed on the inside and outside of the spiral. As those skilled in the art will understand, when the frequency increases, there is a wide divergence in the impedances of the various ports. This asymmetry seriously impacts the coupling performance of the device. What is needed, therefore, is a miniaturized coupler device that eliminates the impedance mismatch between coupler ports.

One approach that has been considered to remedy the asymmetric impedance issue described above is to employ several (e.g., at least four (4)) layers of spiraled transmission lines, coupled in groups and interconnected by transmission line vias that are disposed vertically between the at least four layers. RF signal traces are disposed on the top layer below the top ground plane, and between the vias and the device pins. However, an issue that may impact the performance of spiral couplers relates to the thermal resistance of the coupled structure. The heat generated by an RF signal as it traverses the signal traces must eventually be dissipated by the heat sink disposed underneath the device. The thermal resistance is proportional to the region disposed under the trace; the greater the vertical distance from the trace to the bottom of the device, the higher the thermal resistance. In this case, because the traces are disposed in the top layer, the thermal energy must be conducted through the entire thickness of the device. Alternatively ground planes may be disposed between the coupled groups and a thermal path realized through interconnecting vias towards the heat sink. The power handling capabilities of these devices is thus lower (i.e. a factor of approximately 0.4 to 0.9, depending on the actual thermal path) than having the entire spiral coupler disposed in one stripline layer. Accordingly, the RF signal power level must be lowered or the device will be impaired or destroyed by the heat generated by the RF signal itself.

To someone skilled in the art, it is obvious that the thermal path is only part of the equation. Equally important, if not more, is the insertion loss of the device. The insertion loss represents the amount of energy that will be dissipated in the device. Thus minimizing the insertion loss will result in less heat being generated in the device, and therefore, less heat needs to be conducted to a heatsink. A device will have a set maximum operating temperature that can be a function of the material characteristics such as the reflow temperature of the port terminal solder used, permanent breakdown of dielectrics or metals as a function of temperature and environment, physical alterations as a function of temperature and environment or temporary performance changes versus temperature. A lower thermal resistance, higher maximum operating temperature and lower insertion loss are therefore the design goals of a high power device.

What is needed is a coupler structure that exhibits the compactness of a spiral coupler for cost, while simultaneously provides symmetric port impedances and high power handling capabilities.

SUMMARY OF THE INVENTION

The present invention addresses the needs described above by providing an unwound/rewound spiral that offers the benefits of a miniaturized low insertion loss coupler having matched (symmetric) coupler port impedances. The coupler of the present invention also provides a coupler having a reduced thickness and strategically placed signal traces such that the device of the present invention offers improved thermal resistance characteristics. Of course, the improved thermal resistance translates into improved power handling capabilities. The unwound/rewound spiral coupler line configuration of the present invention provides an increased line density suitable for implementing miniaturized low loss coupler devices. Furthermore, the transmission lines are disposed in a manner as to protect them from potential hazardous environment to increase the maximum operational temperature.

One aspect of the present invention is directed to a coupler that includes a coupler structure including at least one first transmission line disposed on a first major surface of a coupler dielectric substrate and at least one second transmission line disposed on a second major surface of the coupler dielectric substrate. The coupler structure includes four symmetric ports such that each port of the four symmetric ports is characterized by substantially identical impedance characteristics. A first ground plane structure is coupled to the coupler structure and including a first outer dielectric material and a first conductive exterior layer disposed substantially parallel to the first major surface. A second ground plane structure is coupled to the coupler structure and including a second outer dielectric material and a second conductive exterior layer disposed substantially parallel to the second major surface. A thermal path is disposed between the coupler structure and at least one of the first conductive exterior layer or second conductive exterior layer. The thermal path is characterized by a thermal resistance substantially within a range between 15 W/mK and 50 W/mK, such that the coupler has a power handling capability of more than 800 W per square inch of heat sink interface.

In another aspect, the present invention is directed to a coupler device that includes a coupler structure having at least one first transmission line formed on a first major surface of a coupler substrate and at least one second transmission line formed on a second major surface of the coupler substrate. The coupler structure further includes an external oxidation barrier disposed over the at least one first transmission line and the at least one second transmission line. The coupler substrate is configured to provide a second oxidation barrier. The first oxidation barrier and the second oxidation barrier substantially encloses the at least one first transmission line and the at least one second transmission line; the first oxidation barrier and the second oxidation barrier being substantially impervious to oxidation. A first ground plane layer includes a first conductive surface disposed over a first composite softboard. The first ground plane layer is disposed such that the first composite softboard covers the first major surface of a coupler substrate and the first conductive surface forms a first exterior device ground plane. A second ground plane layer includes a second conductive surface disposed over a second composite softboard, the second ground plane layer being disposed such that the second composite softboard covers the second major surface of the coupler substrate and the second conductive surface forms a second exterior device ground plane.

In yet another aspect, the present invention is directed to a coupler device that includes a coupler structure. The coupler structure includes at least one first transmission line having a first wound transmission line portion connected to a second wound transmission line portion by a first interconnecting transmission line portion. The first wound transmission line portion, the second wound transmission line portion and the first interconnecting transmission line portion are formed from a single transmission line disposed on a first major surface of a coupler dielectric substrate. The coupler structure also includes at least one second transmission line having a third wound transmission line portion connected to a fourth wound transmission line portion by a second interconnecting transmission line portion. The third wound transmission line portion, the fourth wound transmission line portion and the second interconnecting transmission line portion being formed from a single transmission line disposed on a second major surface of the coupler dielectric substrate parallel to the first major surface. The third wound transmission line portion and the first wound transmission line portion forming a first coupler center portion and the fourth wound transmission line portion and the second wound transmission line portion forming a second coupler center portion such that a continuous magnetic (H) field ring is generated when current is propagating in the at least one first transmission line. The continuous H field ring bisects the first coupler center portion and the second coupler center portion. A first ground plane structure is disposed adjacent to the first major surface of the coupler dielectric substrate. The first ground plane structure includes at least one layer of a first dielectric substrate and a first conductive exterior layer disposed substantially parallel to the first major surface. A second ground plane structure is disposed adjacent to the second major surface of the coupler dielectric substrate. The second ground plane structure including a second dielectric substrate and a second conductive exterior layer disposed substantially parallel to the second major surface.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1A:
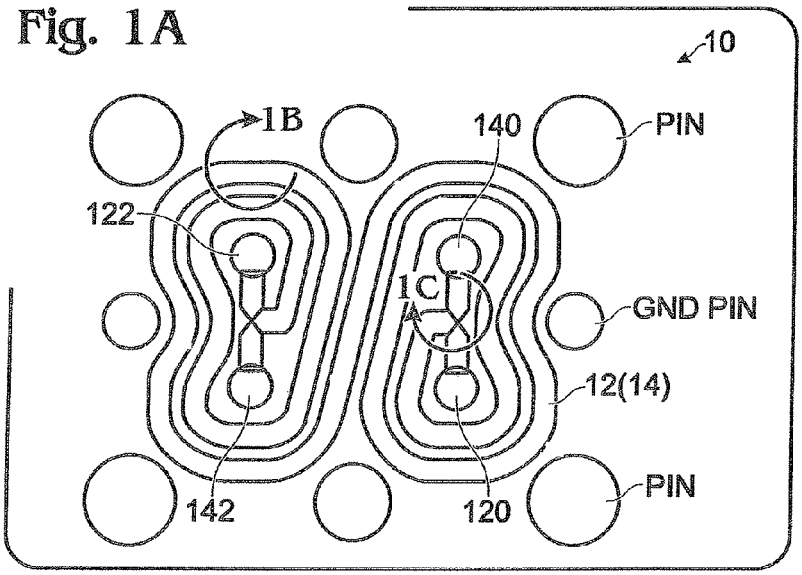
FIG. 1 provides a plan and detail views of an unwound/rewound coupler pattern in accordance with an embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the coupler of the present invention is shown in FIG. 1, and is designated generally throughout by reference numeral 10.

Figure 1B:
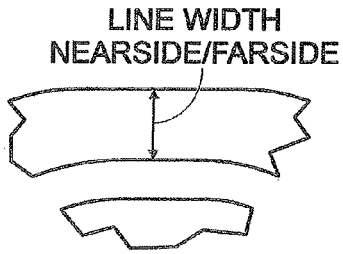
Figure 1C:
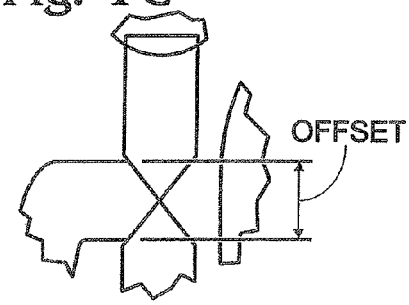

As embodied herein and depicted in FIGS. 1A-1C, plan and detail views of an unwound/rewound coupler 10 in accordance with an embodiment of the present invention are disclosed. Transmission line 12 is disposed on one side of a dielectric layer 1000 and another transmission line layer 14 is disposed on the other side of the dielectric layer 1000 (layer 3) to form the unwound/rewound coupler structure of the present invention. The term "unwound/rewound" refers to the plan-view arrangement (depicted in FIG. 1A) that provides two substantially spiral shaped "windings" (right and left) formed by one transmission line on each surface of the dielectric layer 1000 (See FIG. 2). The first wound portion on the right hand side of FIG. 1A includes port 120 connected to one end of the transmission line 12. Port 120 is coupled to pin 2 (not shown in this view) by way of a vertical transmission line via. Also on the right hand side, transmission line 14 (disposed underneath transmission line 12) is connected to port 140 which is coupled to pin 3 (not shown in this view) by way of another vertical transmission line via. The wound spiral coupler structure on the left includes ports 122 and 142, which are coupled to pins 1 and 4 (not shown in this view), respectively.

It will be apparent to those of ordinary skill in the pertinent art that modifications and variations can be made to dielectric layer 1000 of the present invention depending on its capability of functioning as an anti-oxidation barrier below the transmission line traces 12, 14. For example, dielectric layer 1000 may be realized using a polyimide dielectric material or certain ceramic materials. Those skilled in the art will understand that any suitable dielectric material may be employed herein. In one embodiment, the polyimide layer is implemented using a commercially available material commonly referred to in the art as PYRALUX®.

One benefit of the so-called unwound/rewound broadside coupler configuration relates to the maximized line width density for a given package size. In other words, the lines may be tightly disposed to increase line density because, unlike meandered line configurations, the RF currents in adjacent lines do not oppose each other. By maximizing line width density, insertion loss is reduced.

Another benefit of the unwound/rewound broadside coupler configuration relates to a marked increase in power handling capabilities. As noted previously, heat generated by an RF signal as it traverses the signal traces must eventually be dissipated by the heat sink disposed typically underneath the device. The thermal resistance is proportional to the region disposed under the trace. The greater the vertical distance from the trace to the bottom of the device, the higher the thermal resistance. In accordance with the present invention, the thermal path disposed between the transmission line traces and the bottom ground plane, for example, may be characterized by a thermal resistance that is substantially within a range between 12 W/mK and 50 W/mK. As such, the unwound/rewound coupler has a power handling capability that is substantially within a range between 800 W per square inch of heat sink interface and 4,000 W per square inch of heat sink interface, depending on the implementation. Power handling capability is increased because the unwound/rewound broadside coupler does not require multiple transmission line layers. The unwound/rewound broadside coupler structure is disposed on one polyimide dielectric layer. Thus, disregarding the area required to make interconnections between multiple stripline layers, the unwound-rewound structure has twice the x-y area and half the z height. This results in at least a factor of 2 improvement in power handling over conventional stacked spiral couplers, with everything else being equal. For example, the unwound/rewound coupler depicted herein may be configured to handle up to approximately 200 W. Meandered couplers, in similar materials and size, typically handle approximately 30 W. Simple spiral couplers may also approach almost 200 W, but as noted above, the ports are asymmetric and the resulting device is unsuitable for power combination in high efficiency balanced amplifier configurations. Stacked spiral couplers can be made symmetric and thus suitable for power combination, but requires the inclusion of additional heat transfer features to approach the same 200 W power handling. The additional heat transfer features increases the total material volume occupied and hence price. Putting it another way, Referring to FIG. 2, a cross-sectional view illustrating one of the initial process steps in manufacturing the coupler of the present invention is disclosed. After the unwound/rewound transmission lines 12, 14 are disposed on either side of the PYRALUX® layer 1000, two PTFE composite boards 2000 are disposed on either side thereof. The polyimide layer 1000 is fusion bonded between two PTFE composite boards 2000. The dielectric constant of each composite PTFE board is approximately equal to 3.0. In one embodiment, these boards are implemented using commercially available ROGERS RO-3003 boards.

Figure 2:
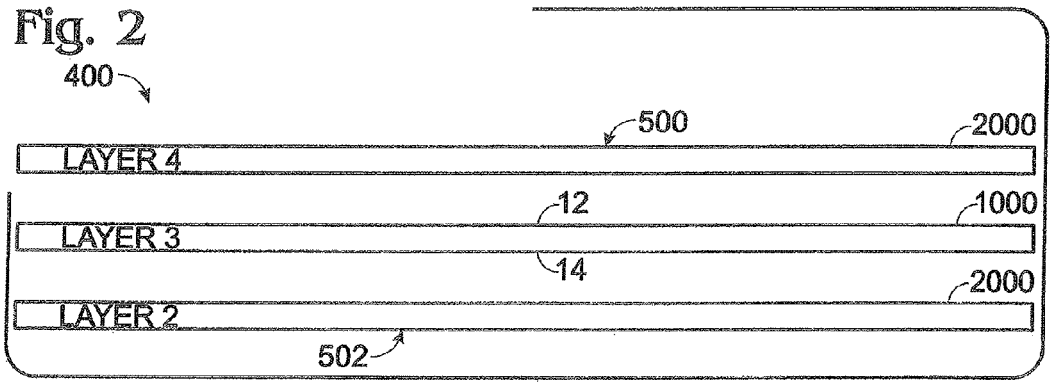
FIG. 2 is an exploded view illustrating the coupler layers including the unwound/rewound coupler pattern depicted in FIG. 3.
Figure 3A:
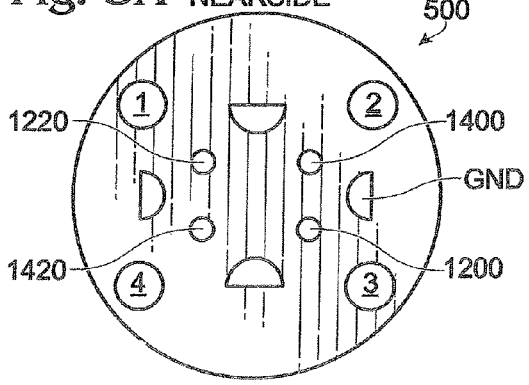
FIG. 3A-3B are plan views of pin and trace placement of the coupler layers depicted in FIGS. 1 and 24.
Figure 3B:
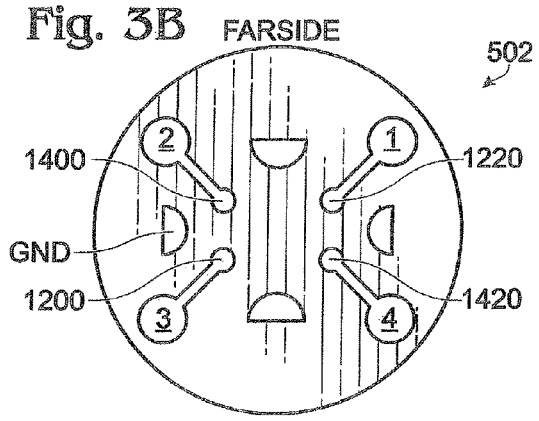

Referring to FIGS. 3A-3B, plan views of pin and trace placement of the coupler layers depicted in FIGS. 1 and 2 are disclosed. The nearside plan view 500 shows the location of pins 1, 2, 3 and 4. The semi-circular portions are vias that are connected to the ground planes. Ports 120, 122, 140 and 142 (See FIG. 1) are connected to vias 1200, 1220, 1400 and 1420, respectively. Conductive vias 1200, 1220, 1400 and 1420 are connected to pins 3, 1, 2 and 4 respectively, by way of the traces shown in FIG. 3B. The output traces are located on the outside mounting surface of layer 2 to minimize the vertical distance between the traces and the heat sink and, hence, minimize thermal resistance and improve power handling. The pin and trace placements depicted in FIGS. 3A-3B are also applicable to the embodiment of FIG. 4.

Figure 4:
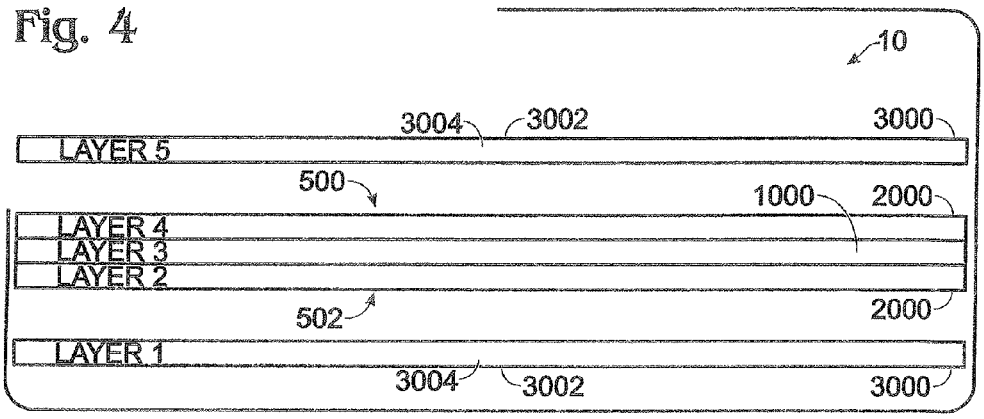
FIG. 4 is an exploded view of the unwound/rewound coupler structure including the coupler layers depicted in FIG. 4.

Referring to FIG. 4, a cross-sectional view of the unwound/rewound coupler of the present invention is disclosed. FIG. 4 illustrates a subsequent process step in the manufacturing of the coupler device 10. In this view, the fusion bonded layers (2-4) shown in FIG. 2 are disposed between two outer layers of PTFE composite layers 3000 (e.g., layer 1 and layer 5). Layers 1-5 refer to the layer stack-up from the bottom of the device to the top of the device. The dielectric constant of the outer PTFE composite layers 3000 is approximately equal to 6.15. In accordance with one embodiment of the invention, the outer layers may be implemented using commercially available ROGERS RO-3006 composite PTFE board. Each board 3000 includes a 0.5 ounce copper layer 3002 disposed over the dielectric layer 3004. Thus, a multi-layer PTFE structure is disposed on either side of the central polyimide layer 1000. Each layer is characterized by a different dielectric constant. The five layers are fusion bonded to create the stripline structure. Of course, the copper layers 3002 form ground planes disposed on the outer surfaces of layer 1 and layer 5. In another embodiment, multiple ground planes may be disposed within the package.

Figure 5:
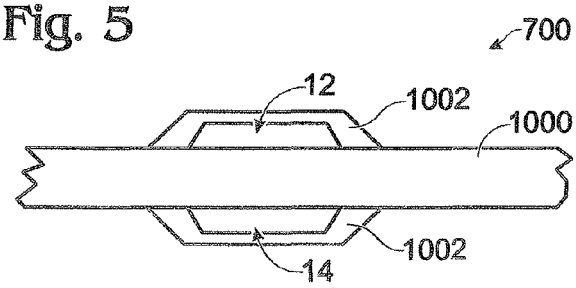
FIG. 5 is a cross-sectional view of the coupler structure illustrating the anti-oxidation features of the present invention.

Referring to FIG. 5, a cross-sectional view of the coupler structure illustrating the anti-oxidation features of the present invention is disclosed. In one embodiment of the present invention, the thickness of the polyimide layer 1000 is approximately 4 mils. The polyimide layer 1000 forms a partial oxygen barrier for the metalized transmission line traces (12, 14). An antioxidation agent is used to form a barrier 1002 for the portion of the traces not protected by polyimide layer 1000. In one embodiment, the antioxidation agent is silver plated onto the metal traces (12, 14). Accordingly, the polyimide material in combination with the silver plating forms a substantially impervious oxidation barrier because the combination substantially reduces the rate of oxidation of the metal traces. Thus, the formed oxygen barrier raises the maximum operating temperature of the traces from less than 160° C. to more than 180° C., with no significant long term material degradation.

Figure 6B:
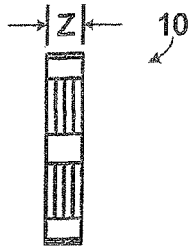
FIGS. 6A-6C are top, side and bottom views of one of the surface mount couplers depicted in FIGS. 1-5.
Figure 6A:
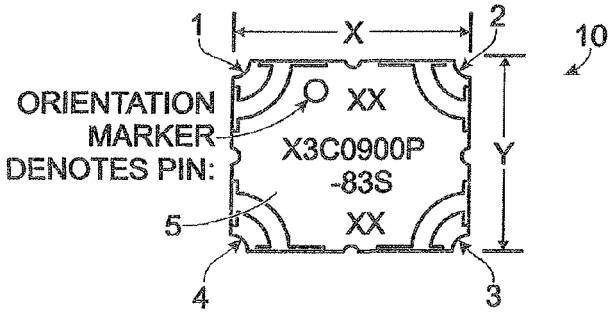
Figure 6C:
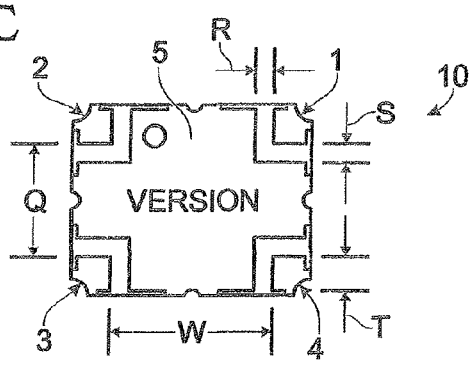

FIGS. 6A-6C are top, side and bottom views, respectively, of a surface mount coupler device in accordance with the present invention (See, e.g., FIGS. 1-5). The X dimension is approximately 0.250 inches, and the Y dimension is approximately 0.200 inches. The thickness (Z-dimension) of the device is approximately 40 mils in this embodiment. The distance ("q") between the pins along the short side of the device is approximately equal to 120 mils in this embodiment. The distance (W) between pins on the long side of the device is approximately 170 mils in this embodiment. The pin dimension ("t") is approximately 34 mils in this embodiment. Finally, the border area between each pin and the ground surface has a thickness ("r") of about 20 mils in this example embodiment.

It will be apparent to those of ordinary skill in the pertinent art that modifications and variations can be made to the number of dielectric layers employed in fabricating coupler 10 of the present invention. In the discussion heretofore, coupler 10 employed five (5) dielectric layers. Those of ordinary skill in the art will understand, however, that the unwound/rewound coupler structure of the present invention may be employed with as little as three (3) dielectric layers. In reference to FIG. 4, layers 2000 may be omitted in other embodiments of the present invention.

Figure 7:
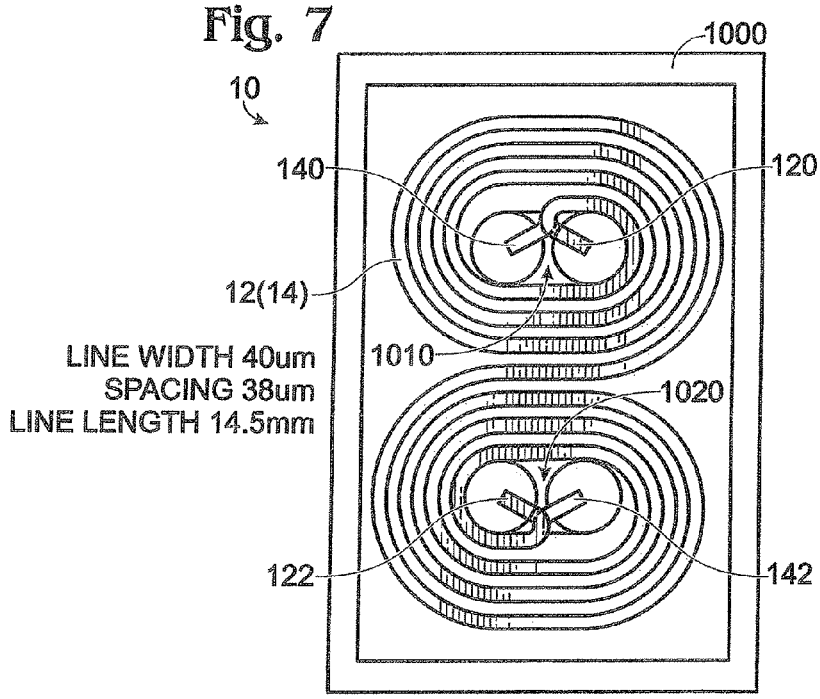
FIG. 7 is a plan view of an unwound/rewound spiral coupler in accordance with another embodiment of the present invention.

As embodied herein and depicted in FIG. 7, a plan view of an unwound/rewound coupler 10 in accordance with another embodiment of the present invention is disclosed. Again, this embodiment may be implemented using three dielectric layers or more, depending on other design considerations. In this embodiment, the unwound/rewound transmission line pattern represents more of a perfect oval geometry than the weaving of the traces in FIGS. 1-6. The line width is approximately equal to 40 μm and the spacing between lines is approximately equal to about 38 μm. FIG. 7, therefore, represents a novel miniaturized spiral structure which offers symmetric port impedances and high power handling capabilities for the size. The unwound/rewound spiral is a combination of two spirals which are connected at an outer winding on each of the spirals. While exemplary values were provided above for both disclosed embodiments, those skilled in the art will recognize that the transmission line geometry, dielectric thicknesses, line widths and line spacings may be varied to obtain the desired coupling value and power handling characteristics. Like the previous embodiment, the inputs and outputs of the spiraled coupler structure are disposed in the center of each spiral. This arrangement offers a degree of symmetry which is beneficial to the performance of coupler designs in many systems.

Figure 8:
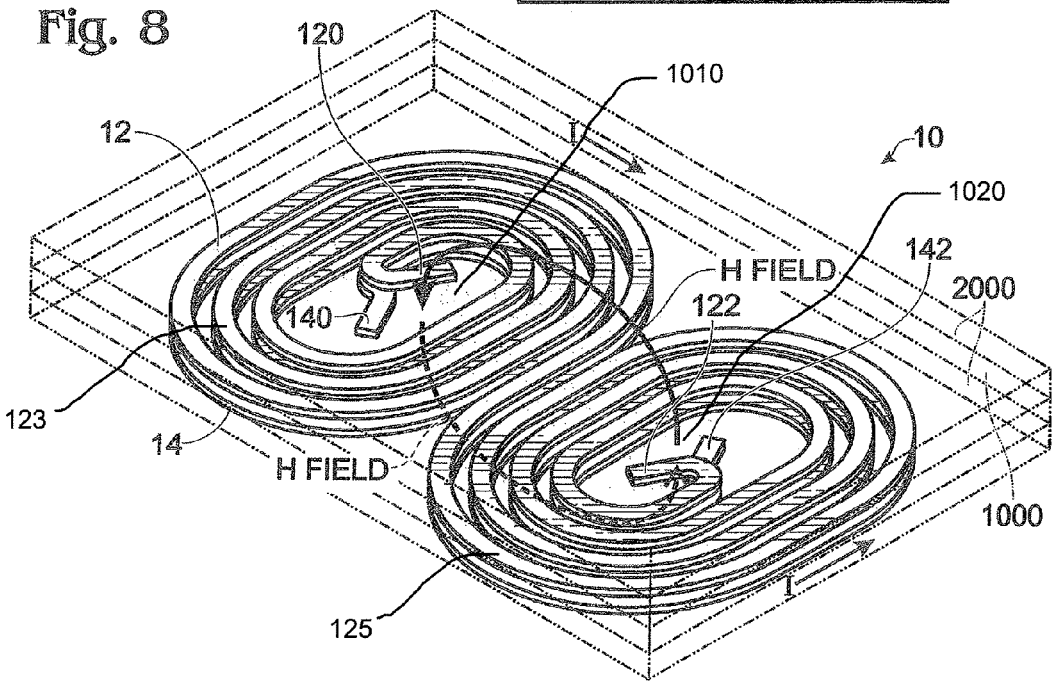
FIG. 8 is a perspective view of the unwound/rewound spiral coupler depicted in FIG. 7.

Referring to FIG. 8, a perspective view of the unwound/rewound spiral coupler depicted in FIG. 7 is disclosed. This view is like FIG. 2 in that it only shows the middle three layers (2,3,4) of the coupler structure 10. The reference numerals are identical to those employed above and any further description could prove to be redundant and is, therefore, omitted for brevity's sake. As noted, transmission line 12 includes a wound transmission line portion 123 (seen on the left side of the FIG. 8) connected to wound transmission line portion 125 (Seen on the right hand side of FIG. 8) by an interconnecting transmission line portion. Wound portion 123 includes a coupler center portion 1010 and wound portion 125 includes coupler center portion 1020. When a current propagates in transmission line 12, for example, a magnetic field (H) is generated. By virtue of the way wound portion 123 is connected to wound portion 125, the magnetic field (H) forms a "ring" that intersects coupler center portion 1010 and coupler center portion 1020 in accordance with the right hand rule.

When comparing a simple spiral coupler and the present invention, the unwound/rewound coupler occupies substantially the same area and height, but offers symmetric port impedances. The unwound/rewound coupler also represents an improvement over meandered coupler structures by providing lower ground plane spacing for the same even mode impedance. Alternatively, the present invention provides wider traces for the same even mode impedance and the same ground plane spacing. Of course, those skilled in the art will understand that these design trade-offs may be employed in combination as desired. Even mode impedance is inversely proportional to the trace/line spacing and hence, in the present invention, the trace/line per area is limited by process capabilities rather than electrical performance concerns. The smaller spacing of the unwound/rewound coupler provides a higher even mode impedance which facilitates a lower height profile or a wider trace line for a given even mode impedance. The wider trace line provides a relatively larger conductor cross-section resulting in lower resistive losses and improved power handling. Of course, when a device has a lower height profile, less material is used, size is reduced, and the device costs less. The lower profile also translates to a lower thermal resistances and, again, higher power handling. Another benefit of the reduced profile height relates to an increase in via reliability. With respect to size and everything else being equal, the unwound/rewound coupler is more compact than meandered couplers by approximately one-half.

The unwound/rewound coupler of the present invention also represents an improvement over a conventional multiple stripline layer implementation of a spiral coupler because its manufacturing process is less complex. Moreover, the unwound/rewound coupler of the present invention includes less layers and has approximately less than half the profile height of the conventional device. Finally, relative to the conventional device, the present invention increases the X-Y area that is in contact with the heat sink, while using substantially the same volume of dielectric materials. Thus, from a thermal path and power handling standpoint, the unwound/rewound coupler of the present invention represents a marked improvement over the conventional spiral coupler referred to above.

It is also noted that the unwound/rewound coupler structure provides two axes of symmetry for the coupler, including the interconnection vias. As noted in the background section, simple spiral couplers require multiple stripline layers to obtain two axes of symmetry. However, one drawback of the simple spiral configuration relates to the fact that the interconnections of the spiral sections cannot be symmetric. This is paramount in applications related to balanced power combination where the transistor impedance loading versus frequency and power must remain symmetric for optimum efficiency.

Another benefit of the unwound/rewound coupler structure relates to the tunability of even-mode impedance. Even-mode impedance can be fine tuned as a function of the trace layout. For example, trace spacings may be varied, the line interconnecting the right winding and the left winding may be "squeezed tightly," i.e., reduced to increase even mode impedance, or be increased to lower the even mode impedance. As another example, the designer has the option of maintaining equal line spacing everywhere or, for instance, open up the line spacing at the corners to provide more line length and less even mode impedance.

In contrast to straight stripline or meandered coupler, where a specific relationship must exist between stripline height, line width and coupled line spacing, the unwound/rewound coupler structure has no such restrictions. Further, in the unwound/rewound coupler structure, the odd mode impedance is largely unchanged with the trace routing modifications described above and thus allows, within some limitations, to design for the desired odd mode impedance using stack-up (Z-dimension) and material properties. The even mode impedance may then be separately adjusted to achieve the correct coupling and system impedance.

Figure 9:
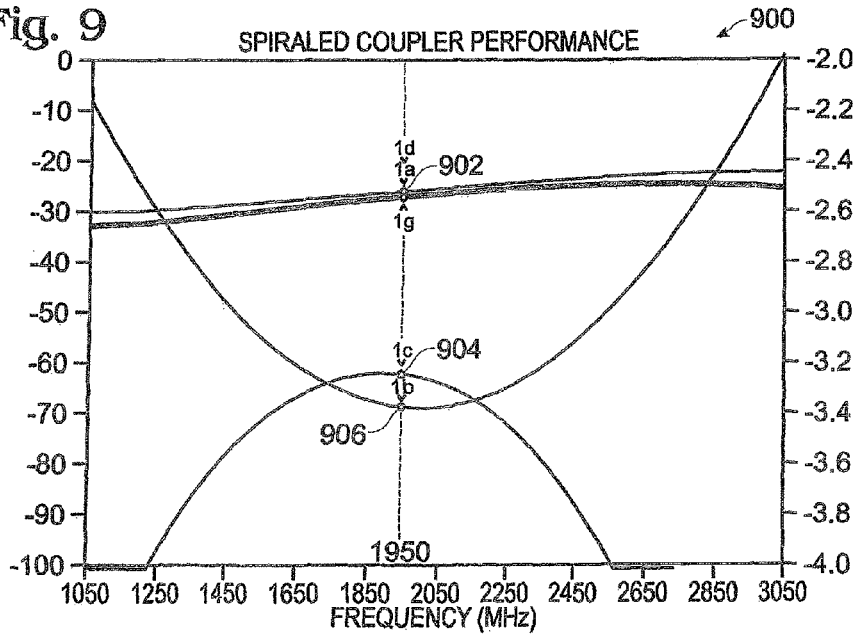
FIG. 9 is a chart illustrating the performance of the unwound/rewound spiral coupler of the present invention.

FIG. 9 is a chart illustrating the performance of the unwound/rewound spiral coupler of the present invention. The unwound/rewound coupled line pair achieves good performance, with return loss and isolation levels below 20 dB. The return losses for each of the ports are superimposed over each other and depicted by line 902. At the center frequency (1950 MHz) the return loss is approximately 27 dB. The insertion loss at the direct port 1106 is approximately −3.4 dB. The insertion loss at the coupled port 904 is about −3.2 dB.

Figure 10:
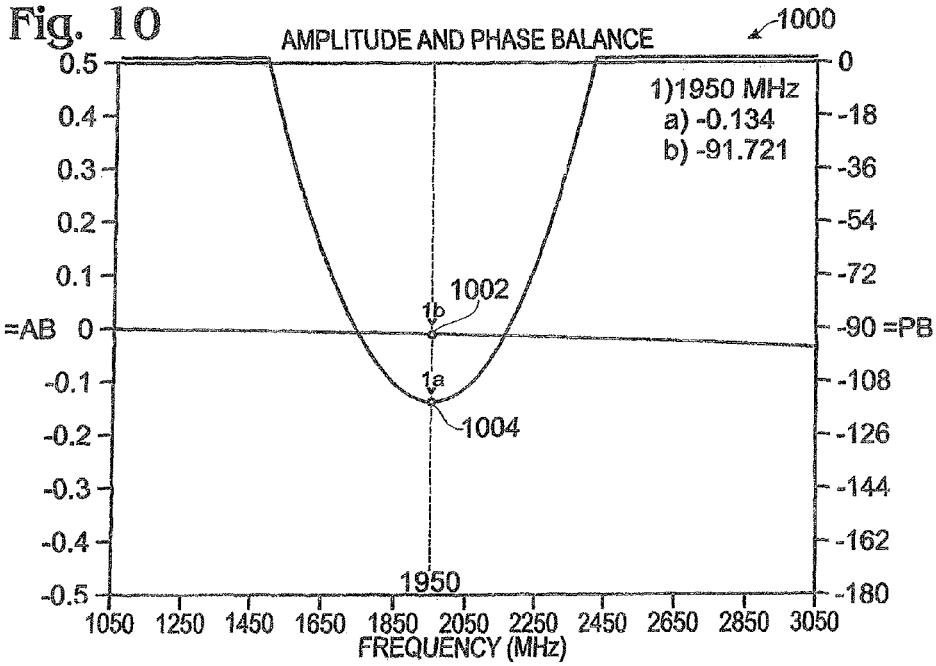
FIG. 10 is a chart illustrating the amplitude and phase balance of the unwound/rewound spiral coupler of the present invention.

FIG. 10 is a chart illustrating the amplitude and phase balance of the unwound/rewound spiral coupler of the present invention. This chart compares the amplitude and phase differences between the direct and coupled ports at line 1004. Clearly, the amplitude difference is negligible (−0.104 dB). An amplitude difference of 0.2 dB or less is considered excellent. The phase difference (1002) is approximately 91 deg. One would expect that the direct and coupled ports be 90 deg out of phase. Accordingly, a phase difference of under +/−2 deg is also considered to be well within tolerance.

Figure 11:
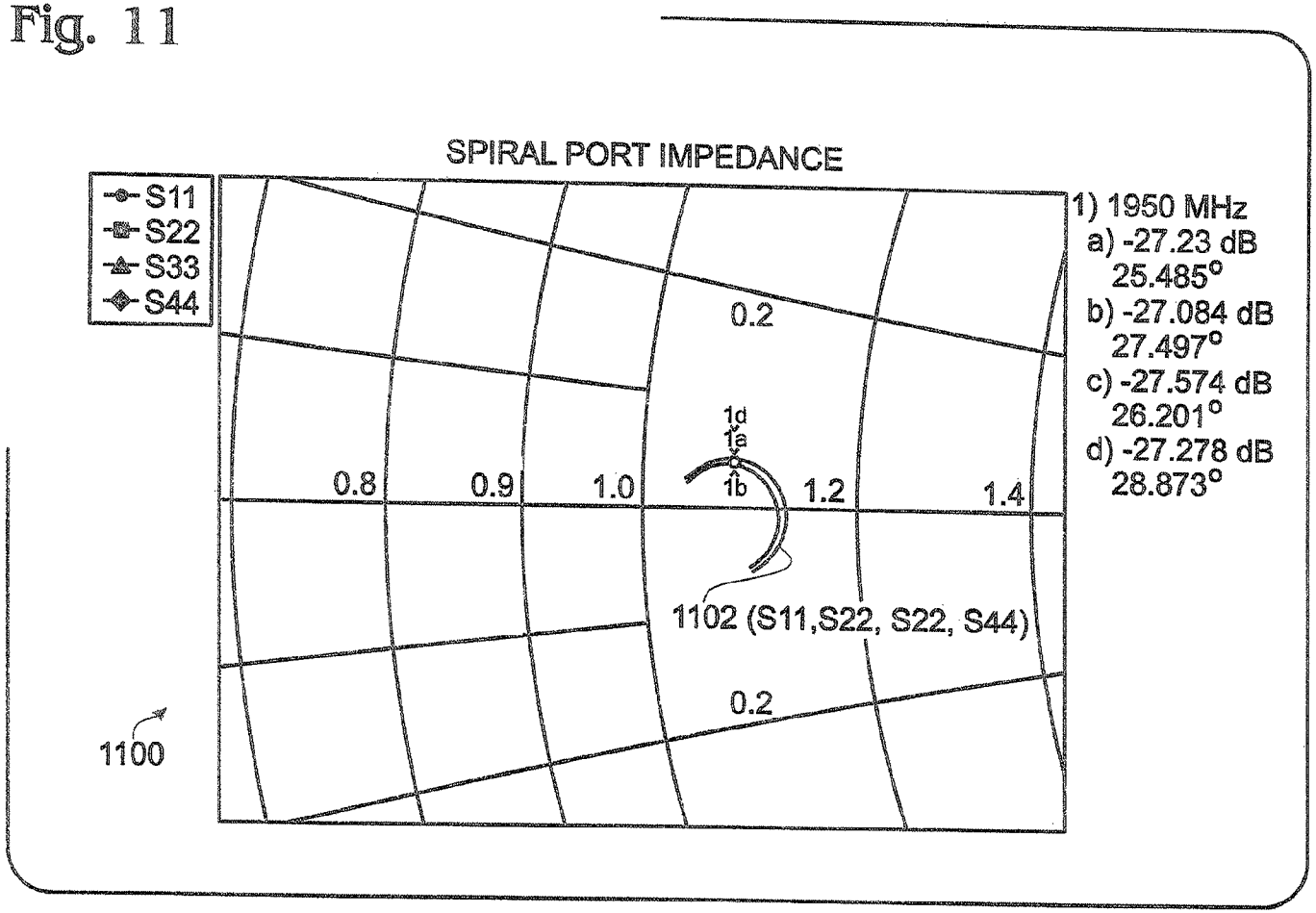
FIG. 11 is a chart illustrating the symmetrical port impedances of the unwound/rewound spiral coupler of the present invention.

FIG. 11 is a chart illustrating the port impedances of the unwound/rewound spiral coupler of the present invention. FIG. 11 offers, for example, a stark comparison to the performance of a simple spiral coupler. One skilled in the art will recognize that the impedance mismatch between the ports of a simple spiraled coupler results in the coupled/direct paths having slightly different port impedances. Again, this impedance asymmetry may have deleterious impact when dividing or combining signals. As shown in FIG. 11, on the other hand, the impedances 1102 of all four ports are identical. In other words, the unwound/rewound coupler exhibits perfect symmetry from an impedance standpoint. Accordingly, the unwound/rewound spiraled broadside coupler of the present invention offers a miniaturized tight coupler design without the inherent asymmetry found in the simple spiraled couplers of the related art.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A coupler comprising:

a coupler structure including at least one first transmission line disposed on a first major surface of a coupler dielectric substrate and at least one second transmission line disposed on a second major surface of the coupler dielectric substrate, the coupler structure including four symmetric ports such that each port of the four symmetric ports is characterized by substantially identical impedance characteristics;

a first ground plane structure coupled to the coupler structure and including a first outer dielectric material and a first conductive exterior layer disposed substantially parallel to the first major surface;

a second ground plane structure coupled to the coupler structure and including a second outer dielectric material and a second conductive exterior layer disposed substantially parallel to the second major surface; and a thermal path disposed between the coupler structure and at least one of the first conductive exterior layer or second conductive exterior layer, the thermal path being characterized by a thermal resistance substantially within a range between 15 W/mK and 50 W/mK, such that the coupler has a power handling capability of more than 800 W per square inch of heat sink interface.

2. The coupler of claim 1, wherein the at least one first transmission line includes a first wound transmission line portion connected to a second wound transmission line portion by a first interconnecting transmission line portion, the first wound transmission line portion, the second wound transmission line portion and the first interconnecting transmission line portion being formed from a single transmission line disposed on a first major surface of a coupler dielectric substrate, and wherein the at least one second transmission line includes a third wound transmission line portion connected to a fourth wound transmission line portion by a second interconnecting transmission line portion, the third wound transmission line portion, the fourth wound transmission line portion and the second interconnecting transmission line portion being formed from a single transmission line disposed on a second major surface of the coupler dielectric substrate parallel to the first major surface, the third wound transmission line portion and the first wound transmission line portion forming a first coupler center portion and the fourth wound transmission line portion and the second wound transmission line portion forming a second coupler center portion such that a continuous H field ring is generated when current is propagating in the at least one first transmission line, the continuous H field ring bisecting the first coupler center portion and the second coupler center portion.

3. The device of claim 2, wherein the coupler structure includes a first inner dielectric layer disposed between the at least one first transmission line and the first outer dielectric material, the coupler structure further including a second inner dielectric layer disposed between the at least one second transmission line and the second outer dielectric layer.

4. The device of claim 3, wherein the coupler dielectric substrate is comprised of a polyimide dielectric material and the first inner dielectric layer and the second inner dielectric layer are comprised of composite dielectric softboard materials.

5. The device of claim 3, wherein at least one of the first inner dielectric layer or the second inner dielectric layer including a set of transmission lines coupled between the four symmetric ports and external pins disposed on an exterior portion of the coupler device.

6. The device of claim 1, wherein the first dielectric substrate is configured to provide a first oxidation barrier under the at least one first transmission line and the at least one second transmission line.

7. The device of claim 6, further comprising a second external oxidation barrier disposed over the at least one first transmission line and the at least one second transmission line, the first oxidation barrier and the second oxidation barrier substantially enclosing the at least one first transmission line and the at least one second transmission line, the first oxidation barrier and the second oxidation barrier being substantially impervious to oxidation.

8. The device of claim 7, wherein the second external oxidation barrier includes a layer of silver material disposed over the at least one first transmission line and the at least one second transmission line.

9. The device of claim 1, wherein the at least one first transmission line includes a plurality of first transmission lines disposed on the first major surface of the coupler dielectric substrate and the at least one second transmission line includes a plurality of second transmission lines disposed on the second major surface of the coupler dielectric substrate.

10. The device of claim 1, wherein the combined thickness of the coupler structure, the first ground plane structure, and the second ground plane structure is less than 35 mils.

11. The device of claim 1, wherein the power handling capability is substantially within a range substantially between 800-4,000 W per square inch of heat sink interface.

12. A coupler device comprising:

a coupler structure including at least one first transmission line formed on a first major surface of a coupler substrate and at least one second transmission line formed on a second major surface of the coupler substrate, the at least one first transmission line and the at least one second transmission line being substantially identical and substantially aligned with each other in a broadside coupled arrangement, the coupler structure further including an external first oxidation barrier disposed over the at least one first transmission line and the at least one second transmission line, the coupler substrate being configured to provide a second oxidation barrier, the first oxidation barrier and the second oxidation barrier substantially enclosing the at least one first transmission line and the at least one second transmission line, the first oxidation barrier and the second oxidation barrier being substantially impervious to oxidation, the coupler structure including four ports, each port of the four ports being characterized by substantially identical impedance characteristics and by an insertion loss of less than 0.14 dB; and a first ground plane layer including a first conductive surface disposed over a first composite softboard, the first ground plane layer being disposed such that the first composite softboard covers the first major surface of a coupler substrate and the first conductive surface forms a first exterior device ground plane; and a second ground plane layer including a second conductive surface disposed over a second composite softboard, the second ground plane layer being disposed such that the second composite softboard covers the second major surface of the coupler substrate and the second conductive surface forms a second exterior device ground plane.

13. The device of claim 12, wherein the coupler structure includes a first composite softboard and a second composite softboard with the coupler substrate disposed therebetween.

14. The device of claim 13, wherein the coupler dielectric substrate is comprised of a polyimide dielectric material.

15. The device of claim 13, wherein the coupler dielectric substrate is comprised of a ceramic dielectric material.

16. The device of claim 14, wherein the external oxidation barrier includes a layer of silver material disposed over the at least one first transmission line and the at least one second transmission line.

17. The device of claim 12, further comprising a thermal path disposed between the coupler structure and at least one of the first conductive surface or second conductive surface, the thermal path being characterized by a thermal resistance substantially within a range between 15 W/mK and 50 W/mK, such that the coupler has a power handling capability of more than 800 W per square inch of heat sink interface.

18. The device of claim 17, wherein the power handling capability is substantially within a range substantially between 800-4,000 W per square inch of heat sink interface.

19. The device of claim 12, wherein the at least one first transmission line includes a first wound transmission line portion connected to a second wound transmission line portion by a first interconnecting transmission line portion, the first wound transmission line portion, the second wound transmission line portion and the first interconnecting transmission line portion being formed from a single transmission line disposed on a first major surface of a coupler dielectric substrate, and wherein the at least one second transmission line includes a third wound transmission line portion connected to a fourth wound transmission line portion by a second interconnecting transmission line portion, the third wound transmission line portion, the fourth wound transmission line portion and the second interconnecting transmission line portion being formed from a single transmission line disposed on a second major surface of the coupler dielectric substrate parallel to the first major surface, the third wound transmission line portion and the first wound transmission line portion forming a first coupler center portion and the fourth wound transmission line portion and the second wound transmission line portion forming a second coupler center portion such that a continuous H field ring is generated when current is propagating in the at least one first transmission line, the continuous H field ring bisecting the first coupler center portion and the second coupler center portion.

20. The device of claim 18, wherein the coupler structure includes a first inner dielectric layer disposed between the at least one first transmission line and the first outer dielectric material, the coupler structure further including a second inner dielectric layer disposed between the at least one second transmission line and the second outer dielectric layer.

21. The device of claim 20, wherein the coupler dielectric substrate is comprised of a polyimide dielectric material and the first inner dielectric layer and the second inner dielectric layer are comprised of composite dielectric softboard materials.

22. The device of claim 20, wherein at least one of the first inner dielectric layer or the second inner dielectric layer including a set of transmission lines coupled between the four symmetric ports and external pins disposed on an exterior portion of the coupler device.

23. The device of claim 12, wherein the at least one first transmission line includes a plurality of first transmission lines disposed on the first major surface of the coupler dielectric substrate and the at least one second transmission line includes a plurality of second transmission lines disposed on the second major surface of the coupler dielectric substrate.

24. The device of claim 23, wherein each of the plurality of first transmission lines corresponds to one of the plurality of second transmission lines such that a plurality of coupler devices are formed.

25. A coupler device comprising:

a coupler structure including, at least one first transmission line including a first wound transmission line portion connected to a second wound transmission line portion by a first interconnecting transmission line portion, the first wound transmission line portion, the second wound transmission line portion and the first interconnecting transmission line portion being formed from a single first transmission line trace disposed on a first major surface of a coupler dielectric substrate, the at least one first transmission line being connected to a first port and a second port, and at least one second transmission line including a third wound transmission line portion connected to a fourth wound transmission line portion by a second interconnecting transmission line portion, the third wound transmission line portion, the fourth wound transmission line portion and the second interconnecting transmission line portion being formed from a single second transmission line trace disposed on a second major surface of the coupler dielectric substrate parallel to the first major surface, the at least one second transmission line being connected to a third port and a fourth port, the single first transmission line trace and the single second transmission line trace being substantially identical and substantially aligned with each other in a broadside coupled arrangement such that the third wound transmission line portion and the first wound transmission line portion form a first coupler center portion and the fourth wound transmission line portion and the second wound transmission line portion form a second coupler center portion such that a continuous H field ring is generated when current is propagating in the at least one first transmission line, the continuous H field ring bisecting the first coupler center portion and the second coupler center portion, the first port, the second port, the third port and the fourth port being characterized by substantially identical impedance characteristics;

a first ground plane structure disposed adjacent to the first major surface of the coupler dielectric substrate, the first ground plane structure including at least one layer of a first dielectric substrate and a first conductive exterior layer disposed substantially parallel to the first major surface; and a second ground plane structure disposed adjacent to the second major surface of the coupler dielectric substrate, the second ground plane structure including a second dielectric substrate and a second conductive exterior layer disposed substantially parallel to the second major surface.

26. The device of claim 25, wherein the coupler structure includes a first inner dielectric layer disposed between the at least one first transmission line and the first outer dielectric material, the coupler structure further including a second inner dielectric layer disposed between the at least one second transmission line and the second outer dielectric layer.

27. The device of claim 26, wherein at least one of the first inner dielectric layer or the second inner dielectric layer include a set of transmission lines coupled between the four symmetric ports and external pins disposed on an exterior portion of the coupler device.

28. The device of claim 26, wherein the coupler dielectric substrate is comprised of a polyimide dielectric material and the first inner dielectric layer and the second inner dielectric layer are comprised of composite dielectric softboard materials.

29. The device of claim 25, wherein the coupler dielectric substrate is configured to provide a first oxidation barrier under the at least one first transmission line and the at least one second transmission line.

30. The device of claim 29, further comprising a second external oxidation barrier disposed over the at least one first transmission line and the at least one second transmission line, the first oxidation barrier and the second oxidation barrier substantially enclosing the at least one first transmission line and the at least one second transmission line, the first oxidation barrier and the second oxidation barrier being substantially impervious to oxidation.

31. The device of claim 29, wherein the second external oxidation barrier includes a layer of silver material disposed over the at least one first transmission line and the at least one second transmission line.

32. The device of claim 25, wherein the at least one first transmission line includes a plurality of first transmission lines disposed on the first major surface of the coupler dielectric substrate and the at least one second transmission line includes a plurality of second transmission lines disposed on the second major surface of the coupler dielectric substrate.

33. The device of claim 25, wherein each of the first port, the second port, the third port and the fourth port are characterized by an insertion loss of less than 0.14 dB.

34. The device of claim 25, further comprising a thermal path disposed between the coupler structure and at least one of the first conductive surface or second conductive surface, the thermal path being characterized by a thermal resistance substantially within a range between 15 W/mK and 50 W/mK, such that the coupler has a power handling capability of more than 800 W per square inch of heat sink interface.

35. The device of claim 34, wherein the power handling capability is substantially within a range substantially between 800-4,000 W per square inch of heat sink interface.

* * * * *